US005917113A

United States Patent [19]

Suzuki

[11] Patent Number: 5,917,113

[45] **Date of Patent: *Jun. 29, 1999**

[54] PROCESS FOR PRODUCING SPHERICAL METAL PARTICLES

[75] Inventor: Gozo Suzuki, Tokyo, Japan

[73] Assignees: Mitsui Mining and Smelting Co., Ltd.; Minerva Kiki Co., Ltd., both of Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/680,644

[22] Filed: Jul. 17, 1996

[51] Int. Cl.[6] ..... B22F 9/10

[52] U.S. Cl. ..... 75/338; 75/331; 75/339

[58] Field of Search ..... 75/331, 338, 339

[56] References Cited

U.S. PATENT DOCUMENTS

| | | | |
|---|---|---|---|
| 3,293,333 | 12/1966 | Woosley | 264/12 |
| 3,752,611 | 8/1973 | Reed et al. | 425/7 |
| 4,585,601 | 4/1986 | Booz et al. | 264/12 |
| 5,073,409 | 12/1991 | Anderson et al. | 427/217 |

FOREIGN PATENT DOCUMENTS

| | | |
|---|---|---|
| 59-14084 | 4/1984 | Japan . |
| 59-29928 | 8/1984 | Japan . |

*Primary Examiner*—Patrick Ryan
*Assistant Examiner*—M. Alexandra Elve
*Attorney, Agent, or Firm*—Young & Thompson

[57] ABSTRACT

A process for producing spherical metal particles comprises the step of spraying a molten metal in a chamber filled with a refrigerant gas through a centrifugal atomizer, wherein the refrigerant gas is a composition comprising nitrogen and oxygen gases or nitrogen gas and air and the concentration of the oxygen ranges from 3 to 600 ppm on the basis of the weight of the composition. The production process of the present invention permits mass-production of fluent, spherical metal particles having a smooth surface, in low cost and excellent in dispersibility in a dispersing medium, which is required when the particles are used as a component for pastes or paint and varnishes, while using a small-sized chamber.

10 Claims, 1 Drawing Sheet

PROCESS FOR PRODUCING SPHERICAL METAL PARTICLES

BACKGROUND OF THE INVENTION

1. Field of the Invention

The present invention relates to a process for producing spherical metal particles and more specifically to an improved process for producing metal particles by spraying a molten metal within a chamber filled with a refrigerant gas using a centrifugal atomizer.

2. Description of the Prior Art

There have conventionally been well-known a process for producing metal particles which comprises the step of spraying a molten metal in a chamber filled with a refrigerant gas using a centrifugal atomizer to cool and solidify the scattered droplets and to thus form metal particles. In this production process, however, the scattered droplets formed by spraying a molten metal in a chamber filled with a refrigerant gas through a centrifugal atomizer should be cooled by the refrigerant gas atmosphere and should completely be solidified till the scattered droplets arrive at the inner wall of the chamber. If the scattered droplets collide with the inner wall of the chamber while they are still in an insufficiently solidified state, the resulting metal particles are adhered to one another and/or they undergo deformation and are correspondingly irregular in shape. For this reason, it has been difficult to obtain spherical metal particles having a uniform diameter. In order to eliminate the foregoing drawback, it is necessary to increase the flying time of the scattered droplets of a sprayed molten metal so that the scattered droplets are completely solidified and it is accordingly necessary to increase the scattering distance thereof. This correspondingly requires the use of an extremely large-sized chamber.

Incidentally, there has been disclosed, in Japanese Examined Patent Publication No. Sho 59-14084, a proposal capable of miniaturization of the chamber by controlling the time required till the scattered droplets of a molten metal are completely solidified through the use of a mixture which comprises at least two inert gases as the refrigerant gas to be used in the chamber. However, the control of the time required for the solidification to a preferred level according to the proposed process requires the use of a large quantity of helium gas which is excellent in heat transfer properties, but is very expensive. Therefore, such a proposed process is suitable for producing metal particles in a laboratory scale, i.e., in a small amount, but it is inevitable that the production of such metal particles in an industrial scale is quite unfavorable in the production cost.

SUMMARY OF THE INVENTION

The inventor of this invention has conducted various studies and investigations and as a result, has found out that the foregoing phenomena that metal particles formed are adhered to one another to form massive particles and that the resulting particles are irregular in shape are closely related to not only the degree of solidification of the scattered metal particles observed when they arrive at the inner wall of the chamber, but also to the surface conditions of the particles observed at that time. More specifically, it has been recognized that, if the scattered metal particles are covered with some hard films, the metal particles are not adhered to one another or do not undergo any agglomeration even when the scattered metal particles are solidified to such an extent that they are adhered to one another; and that, if the surface of the scattered metal particles are covered with films, these metal particles may be recovered from some deformation thereof caused by collision of the particles with the inner wall of the chamber or other metal particles already attached to the wall, even if the scattered metal particles are insufficiently solidified.

Such films on the scattered metal particles are formed through oxidation of the metal. For this reason, the foregoing phenomena such as mutual adhesion of these metal particles and/or agglomeration thereof can be eliminated by adding oxygen gas to the inert refrigerant gas used in the process for producing such metal particles in which a molten metal is sprayed within a chamber filled with such a refrigerant gas using a centrifugal atomizer, to thus form films on the surface of the scattered metal particles.

Accordingly, an object of the present invention is to provide a process for mass-producing fluent, spherical metal particles having a smooth surface in low cost, while using a small-sized chamber, by improving the surface conditions of scattered metal particles during processes for cooling and solidifying scattered droplets of a molten metal in the production of such metal particles by spraying such a molten metal in a chamber filled with a refrigerant gas through a centrifugal atomizer.

More specifically, the present invention relates to a process for producing spherical metal particles which comprises the step of spraying a molten metal in a chamber filled with a refrigerant gas through a centrifugal atomizer, wherein the refrigerant gas is a composition comprising nitrogen and oxygen gases or nitrogen gas and air and the concentration of the oxygen ranges from 3 to 600 ppm on the basis of the weight of the composition.

DESCRIPTION OF THE PREFERRED EMBODIMENTS

Figure 1:
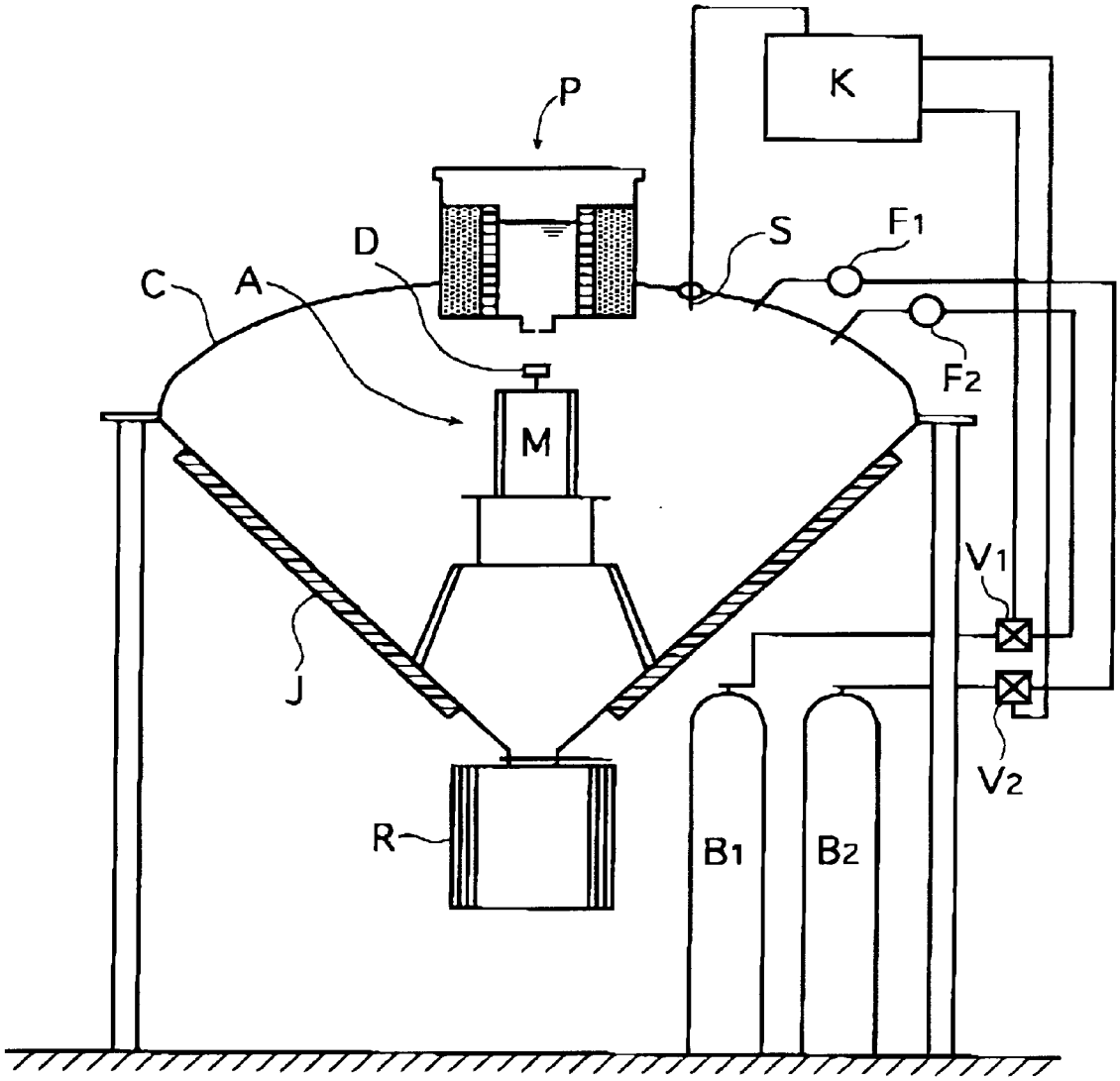
FIG. 1 is a schematic diagram for illustrating the principal parts of an apparatus used in Example of the present invention.

Metals used for forming into spherical particles by the production process according to the present invention include any metals capable of easily forming an oxide thereof in the molten state, for instance, elemental metals such as aluminum, zinc, copper, tin, lead, zirconium, iron, magnesium, manganese; and alloys, intermetallic compounds and metal mixtures comprising these elemental metals.

The refrigerant gases usable in the production process of the present invention is a composition essentially consisting of nitrogen and oxygen and it should satisfy such an essential requirement that the concentration of the oxygen ranges from 3 to 600 ppm on the basis of the weight of the composition. The use of the composition having such an oxygen concentration permits the production of fluent, spherical metal particles having a smooth surface using a small-sized chamber in low production cost and in high yield. If the oxygen concentration is less than the lower limit, i.e., 3 ppm, the oxide film is not sufficiently formed on the resulting metal particles and for this reason, if a small-sized chamber is used, scattered droplets of a molten metal which are still in an insufficiently cooled and solidified state collide against the inner wall of the chamber and/or collide with other metal particles already attached to the inner wall to thus undergo phenomena such as mutual adhesion and/or deformation and this results in the formation of metal particles non-uniform in shape. On the other hand, if the oxygen concentration exceeds the upper limit, i.e., 600 ppm, a large amount of coarse clast-like metal oxide is formed on the surface of the resulting metal particles and as a result, the applicability of the resulting metal particles is considerably limited or reduced. For instance, when using them as a granular solder, the oxide film is too thick and the compatibility thereof with fluxes is impaired, or when producing aluminum powder for synthetic resin paint and varnishes, the resulting metal particles are insufficiently dispersed in a liquid resin. The oxygen concentration of the refrigerant gas preferably ranges from 10 to 500 ppm and most preferably 20 to 300 ppm. In this respect, if the oxygen concentration ranges from 3 to 20 ppm, the resulting metal particles has a tendency of containing a small amount of elliptical metal particles, but the presence thereof does not interfere with the applicability of the metal particles.

It is not necessary to always use pure oxygen as an oxygen source for the refrigerant gas composition used in the production process of the present invention and air may be used as such an oxygen source. The air is a composition comprising about 78% of nitrogen, about 1% of other inert gases and about 21% of oxygen. Therefore, if air is incorporated into nitrogen gas in such a manner that the resulting refrigerant gas composition comprises oxygen in an amount falling within the range defined above, the concentration of inert gases other than nitrogen is less than 1/20 time that of the oxygen and can be disregarded, even when air is substituted for pure oxygen gas.

When practicing the production process according to the present invention, it is desirable that the temperature in the chamber be maintained at a level of from about 25 to 30° C. by cooling the wall of the chamber with water and that the chamber be slightly pressurized, for instance, the pressure therein be maintained at about 1.1 atm. Moreover, the number of revolutions of a rotary disc of a centrifugal atomizer for spraying a molten metal may arbitrarily be determined depending on the viscosity of the molten metal to be formed into spherical particles and/or the desired particle size of the metal particles to be formed. For instance, the number of revolutions thereof may be set at a range of from 25,000 to 120,000 rpm. In this respect, the smaller the particle size of the metal particles to be formed, the higher the number of revolutions.

EXAMPLE

There were produced Pb-Sn eutectic solder particles and aluminum powder for paints and varnishes under the conditions specified in the following Table 1, using the apparatus shown in FIG. 1 according to the production process of the present invention. In the apparatus shown in FIG. 1, C represents a chamber provided with a water-cooling jacket J; a crucible P is positioned at the top of the chamber C; the chamber C accommodates a centrifugal atomizer A which comprises a rotary disc D and a motor M; a sensor S for analyzing the composition of a refrigerant gas is positioned within the chamber C; a receiver R for receiving particulate metal particles is arranged at a lower part of the chamber C; a nitrogen gas bomb $B_1$ and an oxygen gas or compressed air bomb $B_2$ are arranged outside the chamber C; electromagnetic valves $V_1$ and $V_2$ and flowmeters $F_1$ and $F_2$ are arranged between these bombs and the chamber C, respectively; and further an automatic control system K for controlling these electromagnetic valves $V_1$ and $V_2$ is positioned between the sensor S for analyzing the composition of the refrigerant gas and the valves $V_1$ and $V_2$. In the apparatus shown in FIG. 1, the chamber has a diameter of 2000 mm and a height of 1400 mm.

These production experiments were each repeated three times and the experimental results, i.e., the average value of three experiments are summarized in Table 1.

TABLE 1

| Article Produced (Particles) | Eutectic Solder | Aluminum for Paint and Varnish |
|---|---|---|
| Temperature in Crucible | 250° C. | 750° C. |
| No. of Revolution of Disc | 35,000 rpm | 50,000 rpm |
| Principal Component of Refrigerant Gas | $N_2$ | $N_2$ |
| Oxygen Concentration (*1) | 50 ppm | 20 ppm |
| Throughput per Hour | 80 kg | 60 kg |
| Particle size | 45μ (*2) | 38μ (*3) |
| Yield (*4) | 80% | 60% |

*1 The oxygen concentration is adjusted by automatically opening and closing the electromagnetic valves $V_1$ and $V_2$ by the action of the automatic control system K provided with an oxygen concentration-indicator which is connected to the sensor S.
*2 Particles which can pass through a sieve of 325 mesh and have a spherical shape.
*3 Particles which can pass through a sieve of 400 mesh and have a spherical shape.
*4 The residue is again molten in the crucible P and reused.

As has been clear from the foregoing description, the surface of the scattered particles of a molten metal sprayed in a chamber through a centrifugal atomizer is oxidized with oxygen present in a refrigerant gas in a low concentration, is thus covered with an oxide film having an appropriate thickness and the metal particles are physically protected by the film, according to the production process of the present invention. Therefore, the metal particles are rarely adhered to one another. Moreover, the shapes of the metal particles are restored immediately after they undergo deformation due to collision between metal particles and/or collision thereof with the inner wall of the chamber and accordingly, the shapes of the metal particles seldom undergo any ultimate change in shape. For this reason, it is not necessary to completely solidify the scattering metal particles till they are attached to the wall of the chamber. This in turn leads to the elimination of the use of helium gas as an inert gas for accelerating cooling or extension of the flying time through the use of a large-sized chamber.

As has been discussed above in detail, the production process of the present invention permits mass-production of fluent, spherical metal particles having a smooth surface, in low cost and excellent in dispersibility in a dispersing medium, which is required when the particles are used as a component for pastes or paints and varnishes, while using a small-sized chamber.

I claim:

1. A process for producing spherical metal particles which comprises the step of spraying a molten metal in a chamber filled with a refrigerant gas through a centrifugal atomizer, wherein the refrigerant gas is a composition consisting essentially of nitrogen and oxygen gases and the concentration of the oxygen ranges from 10 to 500 ppm on the basis of the weight of the composition.

2. The production process of claim 1 wherein the composition used has an oxygen concentration ranging from 20 to 300 ppm on the basis of the weight of the composition.

3. A process for producing spherical metal particles which comprises the step of spraying a molten metal in a chamber filled with a refrigerant gas through a centrifugal atomizer, wherein the refrigerant gas is a composition consisting essentially of nitrogen gas and air and the concentration of the oxygen ranges from 10 to 500 ppm on the basis of the weight of the composition.

4. The production process of claim 3 wherein the composition used has an oxygen concentration ranging from 20 to 300 ppm on the basis of the weight of the composition.

5. The production process of claim 1, further comprising maintaining the temperature in the chamber to a level ranging from about 25° to 30° C.

6. The production process of claim 1, further comprising maintaining the pressure in the chamber to about 1.1 atmospheres.

7. The production process of claim 1, wherein the centrifugal atomizer comprises a rotary disc which is operated at a range of 25,000 to 120,000 rpm.

8. The production process of claim 3 further comprising maintaining the temperature in the chamber to a level ranging from about 25° to 30° C.

9. The production process of claim 3, further comprising maintaining the pressure in the chamber to about 1.1 atmospheres.

10. The production process of claim 3, wherein the centrifugal atomizer comprises a rotary disc which is operated at a range of 25,000 to 120,000 rpm.

* * * * *